United States Patent [19]

Iwamoto

[11] Patent Number: 4,891,556

[45] Date of Patent: Jan. 2, 1990

[54] COUPLED-CAVITY DELAY LINE FOR TRAVELING-WAVE TUBE

[75] Inventor: Mitoshi Iwamoto, Tokyo, Japan

[73] Assignee: NEC Corporation, Japan

[21] Appl. No.: 56,539

[22] Filed: Jun. 1, 1987

[30] Foreign Application Priority Data

May 31, 1986 [JP] Japan ..... 61-127050

[51] Int. Cl.[4] ..... H01J 25/34

[52] U.S. Cl. ..... 315/3.5; 315/39.3; 315/112; 315/50; 313/17; 313/45

[58] Field of Search ..... 315/3.5, 4, 3.6, 5, 315/39.3, 112, 56; 313/17, 45

[56] References Cited

U.S. PATENT DOCUMENTS

| | | | |
|---|---|---|---|
| 3,398,315 | 8/1968 | Washburn | 313/46 |
| 3,678,327 | 7/1972 | Schmidt | 313/45 |
| 4,243,914 | 1/1981 | Delorg et al. | 313/17 |
| 4,471,266 | 9/1984 | Fleurg et al. | 313/17 |
| 4,658,183 | 4/1987 | Huber | 315/3.5 |
| 4,748,377 | 5/1988 | King | 315/3.5 |

*Primary Examiner*—Leo H. Boudreau
*Assistant Examiner*—Michael Razavi
*Attorney, Agent, or Firm*—Laff, Whitesel, Conte & Saret

[57] ABSTRACT

A coupled-cavity delay line for a traveling-wave tube which includes a device for focusing an electron beam along the axis of the delay line for interaction between the electron beam and an electromagnetic wave propagating along the delay line. The focusing device includes an alternate series of permanent magnets and pole pieces which confine resonant cavities on each side. Each of the pole pieces is common to a pair of adjacent cavities and is provided with a drift tube which is positioned at a center thereof and which has a central aperture for passage of the electron beam. Each of the pole pieces is also pierced by at least one intercavity coupling aperture. The delay line also comprises a heat transfer member provided in at least one of the pole pieces to extend from the drift tube to the outside of the pole piece. This heat transfer member is made of a material such as copper having a heat conductivity higher than that of a pole piece.

16 Claims, 5 Drawing Sheets

COUPLED-CAVITY DELAY LINE FOR TRAVELING-WAVE TUBE

BACKGROUND OF THE INVENTION

1. Field of the Invention

The present invention relates to a traveling-wave tube, and more specifically to a delay line of the coupled-cavity type employed in a traveling-wave tube and having a high cooling characteristics.

2. Description of related art

At present, various traveling-wave tubes have been used in the field of telecommunication and broadcasting. In general, a traveling-wave tube comprises an evacuated envelope as of copper, containing an electron gun assembly at one end thereof for forming and projecting a beam of electrons over an elongated beam path to an electron collector electrode at the opposite end of the envelope. A slow-wave circuit or delay line is arranged along the beam path intermediate the electron gun and the beam collector for electromagnetic interaction with the beam. Input microwave signals to be amplified are applied to the upstream end of the delay line, and amplified output signals are extracted from the downstream end of the delay line. A periodic permanent magnetic arrangement is coaxially disposed to surround the envelope for producing axially arranged periodic magnetic fields within the envelope so as to focus the beam through the delay line.

The delay line employed in the traveling-wave tube as mentioned above is broadly divided into a helix slow-wave circuit and a coupled-cavity delay line. Referring to FIGS. 1 and 2, there is partially shown a typical example of the conventional coupled-cavity delay line for the traveling-wave tube. The shown delay line comprises a plurality of coupled cavities and a series of disks of magnetic material or pole pieces 10 aligned in parallel relation to each other along a common axis O—O which coincides with the axis of propagation of the electron beam. The delay line also includes a series of tubular members 11 made of for example copper, located coaxially to the common axis O—O with each of the tubular members being interposed between a pair of adjacent pole pieces. Each of the tubular members thus cooperates a pair of pole pieces located at opposite ends thereof to confine one cavity. Therefore, the pole pieces 10 form the wall which is common to two adjacent cavities 12. Each pole pieces 10 is pierced by two apertures 14 which provide a coupling between cavities. The pair of apertures are symmetrical with respect to the axis of the line O—O. In addition, each pole piece 10 is also pierced by an aperture 16 through which the electron beam is intended to pass. The aperture 16 is located at the center of the pole piece. In addition, the aperture 16 is usually of circular shape and surrounded by a coaxial annular flange designated as a drift tube 18. This drift tube is brazed to the pole piece 10. An electron-beam focusing device surrounds the cavities and is constituted by an alternate arrangement of permanent magnets 20 and pole pieces 10. Furthermore, for forced air cooling, the delay line includes a number of heat radiating or releasing fins 22 extending radially from a periphery of each pole piece 10 in equal angular intervals.

In operation, the drift tubes 18 are heated by a so-called body current and an induction current. The heat of the drift tubes 18 are transferred to the associated pole pieces 10 and then dissipated from the radiator fins 22.

In general, the larger the mean RF power becomes, the more the amount of heat generated in the drift tubes becomes. On the other hand, the pole pieces 10 are ordinarily made of soft iron to constitute magnetic circuit in cooperation with the periodic permanent magnets 20. The soft iron has fairly low heat conductivity, and therefore, if the heat of the drift tubes is increased, the pole piece cannot effectively transfer heat from the drift tube to the radiator fins 22. As a result, local overheating of a drift tube will often occur, which will have serious consequences such as generation of gas in the cavities and even cause destruction of the traveling-wave tube as a result of melting of the drift tube.

For overcoming this problem, U.S. Pat. No. 4,471,266 proposes installation of heat pipes actually extending through a series of pole pieces, so that the drift tubes are forcedly cooled via the associated pole pieces by a cooling liquid flowing through the heat pipes. However, this cooling is yet not sufficient, because the heat generated in the drift tube is transferred through the iron pole piece to the heat pipes. In addition, this cooling system is complicated in structure, and further has a latent danger such as cooling liquid leakage and damage of the heat pipes which would be caused when the cooling liquid is frozen.

SUMMARY OF THE INVENTION

Accordingly, it is an object of the present invention to provide a coupled-cavity delay line for a traveling-wave tube, free of the drawbacks of the conventional ones.

Another object of the present invention is to provide a coupled-cavity delay line which can be incorporated in a traveling-wave tube and which can effectively transfer heat generated in drift tubes to the exterior for heat dissipation.

Still another object of the present invention is to provide a coupled-cavity delay line of air-cooled type for a traveling-wave tube, which can effectively transfer heat of drift tubes to an air cooled fins, even if a large amount of heat is generated in the drift tubes.

The above and other objects of the present invention are achieved in accordance with one aspect of the present invention by a coupled-cavity delay line for a traveling-wave tube which includes a device for focusing an electron beam along the axis of the delay line for interaction between the electron beam and an electromagnetic wave propagating along the delay line, the focusing device including an alternate series of permanent magnets and pole pieces which confine resonant cavities on each side, each of the pole pieces being common to a pair of adjacent cavities and being provided with a drift tube which is positioned at a center thereof and which has a central aperture for passage of the electron beam, each of the pole pieces being also pierced by at least one intercavity coupling aperture, wherein the improvement comprises a heat transfer member provided in at least one of the pole pieces to extend from the drift tube to the outside of the pole piece, the heat transfer member being made of a material having a heat conductivity higher than that of the pole piece.

With the above arrangement, the heat generated in the drift tube is transferred through the heat transfer member having a heat conductivity higher than the pole piece. Therefore, the heat can be effectively conveyed to the outside of the resonant cavity. On the other hand, since the pole piece can be still made of magnetic material such as iron, the function of the magnetic circuit is ensured.

In a preferred embodiment of the delay line, the heat transfer member is embedded in the pole piece so that the heat transfer member does not expose to the space defined in the resonant cavity. Also, the heat transfer member is made of copper.

In a first embodiment, the heat transfer member includes a pair of heat transfer rods brazed at one end thereof to the drift tube and extending from the drift tube in diametrically opposite directions so that the other free end of each rod projects from the periphery of the pole piece.

In a second embodiment, the heat transfer member includes a pair of heat transfer rods extending in parallel to each other, these rods being brazed at their center portions to the drift tube in such a manner that the drift tube is interposed between the pair of rods in a diametrical direction, each end of the rods projecting from the periphery of the pole piece.

In the above two embodiments, preferably, the end of the heat transfer rod projecting from the periphery of the pole piece has a plurality of heat radiation fins.

In a third embodiment, the heat transfer member is composed of a plate sandwiched by a pair of magnetic material plates each of which confines one resonant cavity, the heat transfer plate being brazed at its center portion to be drift tube and extending at least to the periphery of the magnetic material plates.

Preferably, the heat transfer plate has a plurality of heat radiation fins integrally extending therefrom to project from the periphery of the magnetic material plates.

According to a second aspect of the present invention, there is provided a coupled-cavity delay line for a traveling-wave tube which includes a device for focusing an electron beam along the axis of the delay line for interaction between the electron beam and an electromagnetic wave propagating along the delay line, the focusing device including an alternate series of permanent magnets and pole pieces which confine resonant cavities on each side, each of the pole pieces being common to a pair of adjacent cavities and being provided with a drift tube which is positioned at a center thereof and which has a central aperture for passage of the electron beam, each of the pole pieces being also pierced by at least one intercavity coupling aperture, wherein the improvement comprises a pair of a heat transfer copper rods provided in at least one of the pole pieces to extend from the drift tube and having their free ends projecting from the periphery of the pole piece, the free ends of the respective heat transfer rods having a plurality of heat radiation fins.

Preferably, the heat transfer member is embedded in the pole piece so that the heat transfer member does not expose to the space defined in the resonant cavity. Further, each of the heat transfer rods is brazed at one end thereof to the drift tube and extending from the drift tube in diametrically opposite directions so that the other free end of each rod projects from the periphery of the pole piece. Alternatively, each of the heat transfer rods extends in parallel to each other, these rods being brazed at their center portions to the drift tube in such a manner that the drift tube is interposed between the pair of rods in a diametrical direction, each end of the rods projecting from the periphery of the pole piece.

According to a third aspect of the present invention, there is provided a coupled-cavity delay line for a traveling-wave tube which includes a device for focusing an electron beam along the axis of the delay line for interaction between the electron beam and an electromagnetic wave propagating along the delay line, the focusing device including an alternate series of permanent magnets and pole pieces which confine resonant cavities on each side, each of the pole pieces being common to a pair of adjacent cavities and being provided with a drift tube which is positioned at a center thereof and which has a central aperture for passage of the electron beam, each of the pole pieces being also pierced by at least one interactivity coupling apertue, wherein the improvement is that at least one of the pole pieces is composed of a pair of magnetic material plates each of which confines one resonant cavity, and a heat transfer copper plate sandwiched by the pair of magnetic material plates, the heat transfer plate being brazed at its center portion to be drift tube and extending at least to the periphery of the magnetic material plates, and the heat transfer plate having a plurality of heat radiation fins provided at the periphery thereof.

The above an other objects, features and advantages of the present invention will be apparent from the following description of preferred embodiments of the invention with reference to the accompanying drawings.

DESCRIPTION OF THE PREFERRED EMBODIMENTS

Figure 3:
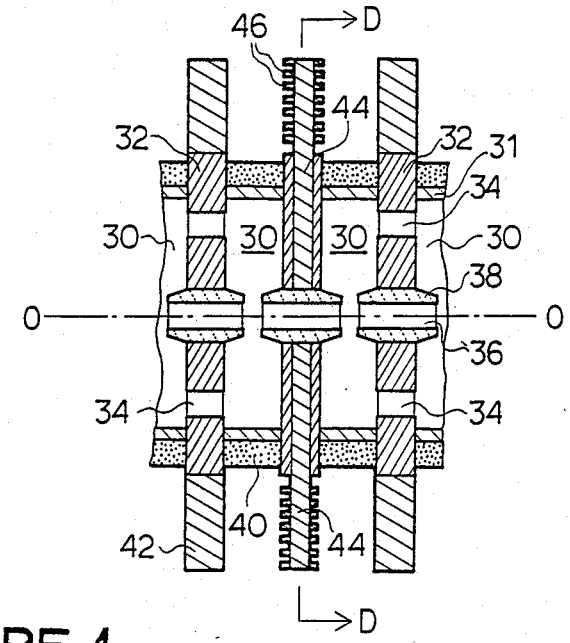
FIG. 3 is a partial longitudinal sectional view of a first embodiment of the coupled-cavity delay line in accordance with the present invention, taken along the line C—C in FIG. 4.
Figure 4:
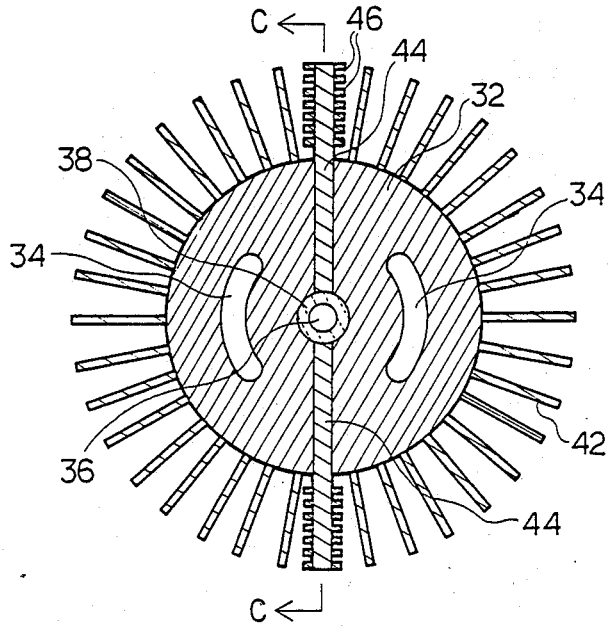
FIG. 4 is a partial transverse sectional view taken from the line D—D in FIG. 3.

Referring to FIGS. 3 and 4, there is shown in part a first embodiment of the coupled-cavity delay line in accordance with the present invention.

The shown delay line comprises a plurality of coupled resonant cavities 30 and a series of iron disks or pole pieces 32 aligned in parallel relation to each other along a common center axis O—O which coincides with the axis of propagation of an electron beam. The delay line also includes a series of tubular members 31 made of for eaxample copper, located coaxially to the common axis O—O with each of the tubular members being interposed between a pair of adjacent pole pieces. Each of the tubular members thus cooperates a pair of pole pieces located at opposite ends thereof to confine one cavity. Therefore, the pole pieces 32 form the wall which is common to two adjacent cavities 30. Each pole piece 32 is pierced by a pair of intercavity coupling apertures 34 which are symmetrical with respect to the axis of the line O—O. In addition, each pole piece 32 is also pierced by an aperture 36 through which the electron beam is intended to pass. The aperture 36 is located at the center of the pole piece 32. In addition, the aperture 36 is usually of circular shape and surrounded by a drift tube 38 brazed to the pole piece 32. An electrobeam focusing device surrounds the cavities and is constituted by an alternate arrangement of permanent magnets 40 and pole pieces 32. Furthermore, for forced air cooling, the delay line includes a number of heat radiating or releasing fins 42 extending radially from a periphery of each pole piece 32 in equal angular intervals.

Figure 1:
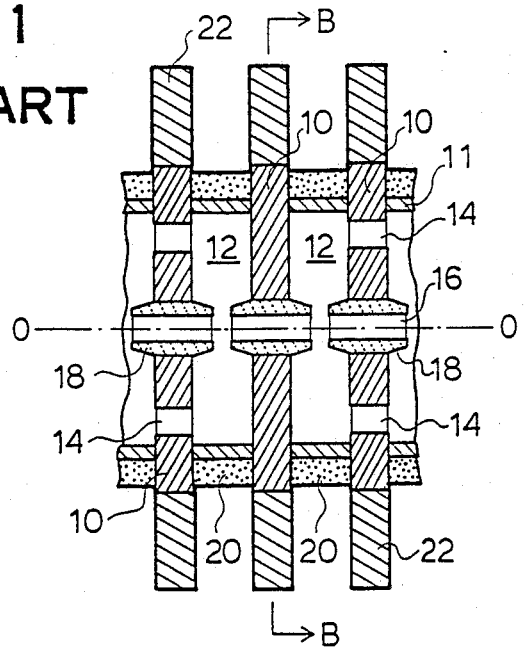
FIGURE 1 PRIOR ART
FIG. 1 is a partial longitudinal sectional view of a conventional coupled-cavity delay line, taken along the line A—A in FIG. 2.
Figure 2:
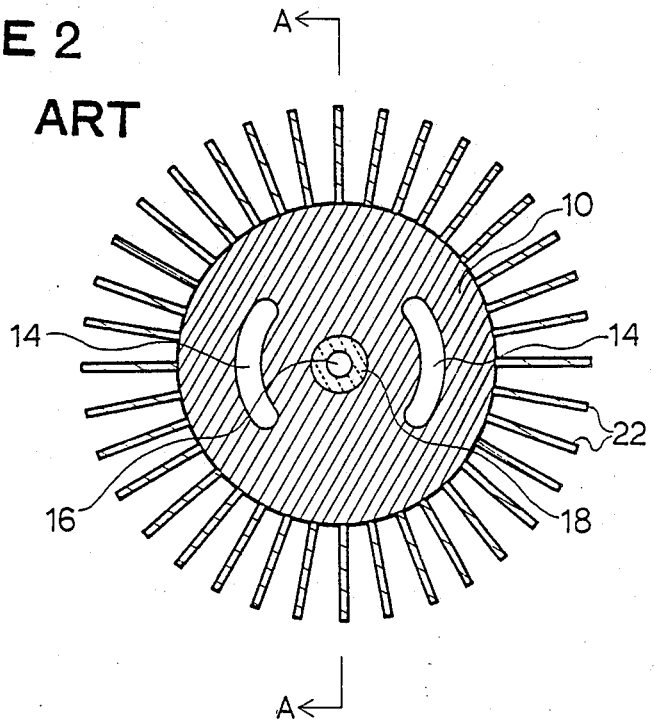
FIGURE 2 PRIOR ART
FIG. 2 is a partial transverse sectional view taken from the line B—B in FIG. 1.

The structure as mentioned above is similar to the conventional one explained with reference to FIGS. 1 and 2. In the shown delay line, furthermore, a center pole piece has a pair of copper heat transfer rods 44 embedded in the pole piece 32. The copper rods 44 are brazed at their inner end to the drift tube 38 and have the other ends extending in diametrically opposite directions so as to project from the periphery of the pole piece 32. The outer end of each copper rod has a plurality of heat radiating or releasing fins 46 brazed thereto and located at the outside of the magnets 40 so that these fins are cooled by a forced air.

In operation, the drift tubes 38 are heated by a so-called body current and an induction current. The heat of the drift tubes 38 is transferred to the associated copper rods 44 and then dissipated from the radiator fins 46 provided on the other end of the rods. Since the rods 44 have a high heat conductivity, the heat can be efficiently transferred and dissipated to the outside of the tube.

Figure 5:
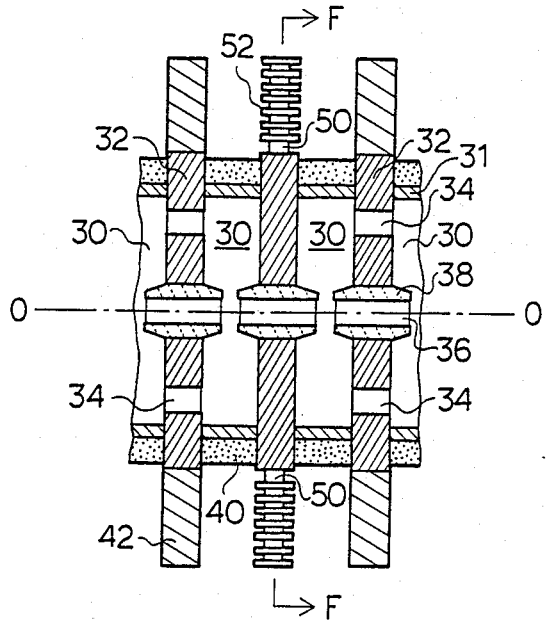
FIG. 5 is a partial longitudinal sectional view of a second embodiment of the coupled-cavity delay line in accordance with the present invention, take along the line E—E in FIG. 6.
Figure 6:
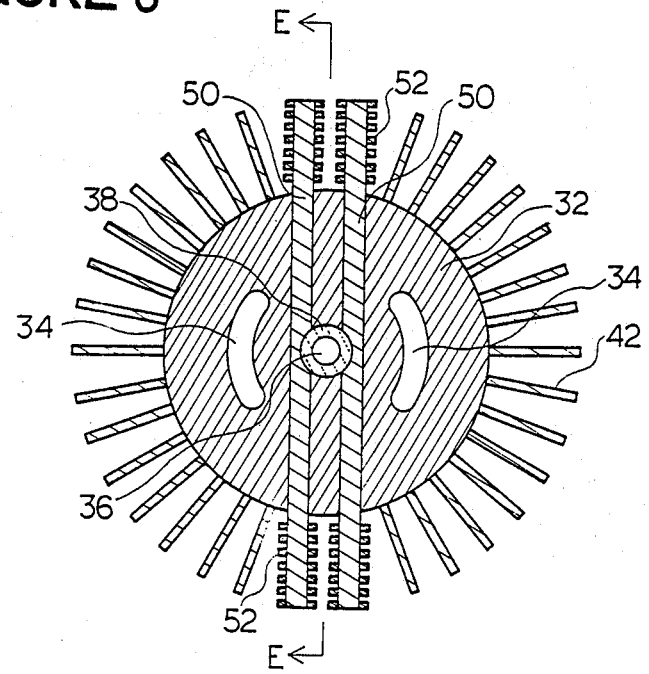
FIG. 6 is a partial transverse sectional view taken from the line F—F in FIG. 5.

Turning to FIGS. 5 and 6, there is shown another embodiment of the coupled-cavity delay line. In these figures, portions similar to those shown in FIGS. 3 and 4 are given the same Reference Numerals, and explanation will be omitted.

The second embodiment includes a pair of copper rods 50 extending in parallel to each other and positioned on both sides of the drift tube 38. These rods 50 are brazed at their center portions to the drift tube in such a manner that the drift tube is interposed between the pair of rods in a diametrical direction. Further, each end of the rods 50 projecting from the periphery of the pole piece 32 and has a plurality of head radiation fins 52.

In this second embodiment, the rods 50 form a heat transfer path from the drift tube to the outside of the tube. The heat path formed by the rods 50 has a sectional area larger than that formed by the rods 44 in the first embodiment. In addition, the total surface area of the fins 52 is larger than that of the fins 46 in the first embodiment. Therefore, the second embodiment has a cooling effect higher than the first embodiment.

In the above two embodiments, the air cooled fins 46 and 52 can be removed and the outer ends of the rods 44 and 50 can be coupled to heat pipes for forced cooling.

Figure 7:
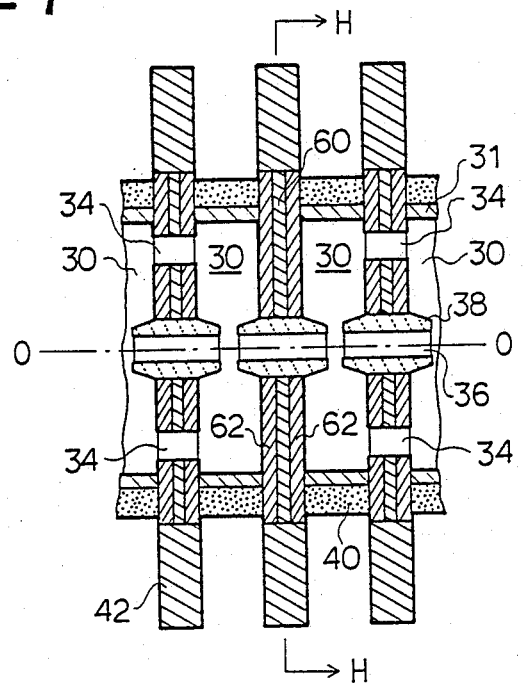
FIG. 7 is a partial longitudinal sectional view of a third embodiment of the coupled-cavity delay line in accordance with the present invention, taken along the line G—G in FIG. 8.
Figure 8:
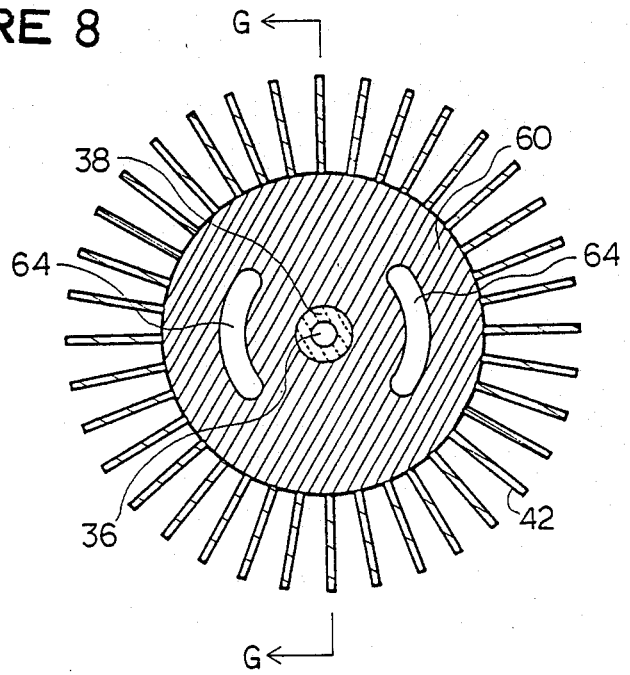
FIG. 8 is a partial transverse sectional view taken from the line H—H in FIG. 7.

In place of the pair of heat transfer rods 44 or 50, three or more heat transfer rods can be provided in equal angular intervals. Further, in the above embodiments a heat transfer member such as the rods 44 and 50 is provided in only one pole piece, but can be provided in a plurality of pole pieces or in all the pole pieces provided in the coupled-cavity delay line. If this idea is developed, the heat transfer rods 44 or 50 can be replaced by a heat transfer plate 60 which is made for example of copper, and which is provided in all the pole pieces, as shown in FIGS. 7 and 8. This plate 60 is sandwiched by a pair of iron plates 62, each of which confines one resonant cavity. The plate 60 is brazed at its center portion to the drift tube 38 and is pierced to have a pair of apertures 64 in consistent with the apertures 34. The copper plate 60 and the iron plates 62 are the same in size and configuration, and the fins 42 are brazed to the periphery of these three plates 60 and 62.

This third embodiment can have a heat path larger than the second embodiment, and therefore, can obtain a further large cooling effect.

Figure 9:
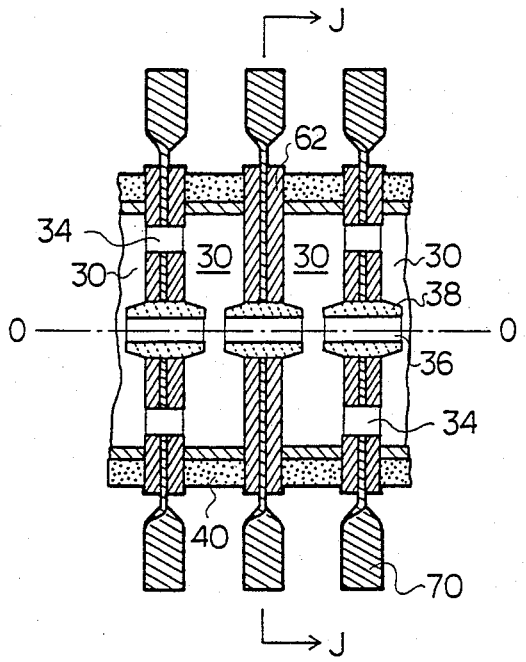
FIG. 9 is a partial longitudinal sectional view of a fourth embodiment of the coupled-cavity delay line in accordance with the present invention, taken along the line I—I in FIG. 10.
Figure 10:
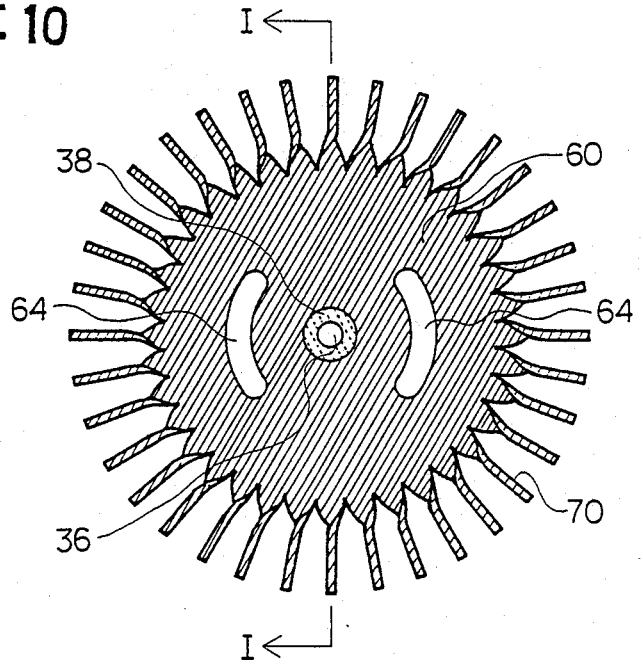
FIG. 10 is a partial transverse sectional view taken from the line J—J in FIG. 9.

As shown in FIGS. 9 and 10, furthermore, the fins 42 brazed to the copper plate 60 and the iron plates 62 can be replaced by a plurality of fins 70 integrally extending from only the periphery of the copper plate 60. These fins 70 can be made by preparing a circular plate larger than the iron plates 62 by the length of the fin 42 radially cutting its peripheral portion at equal intervals and bending all the cut fins in alignment with the axial direction of the tube.

The invention has thus been shown and described with reference to the specific embodiments. However, it should be noted that the invention is in no way limited to the details of the illustrated structures but changes and modifications may be made within the scope of the appended claims.

I claim:

1. A coupled-cavity delay line for a traveling-wave tube which includes a device for focusing an electron beam along the axis of the delay line for interaction between the electron beam and an electromagnetic wave propagating along the delay line, the focusing device including an alternate series of permanent magnets and pole pieces which confine resonant cavities on each side, each of the pole pieces being common to a pair of adjacent cavities and being provided with a drift tube which is positioned at a center thereof and which has a central aperture for passage of the electron beam, each of the pole pieces being also pierced by at least one intercavity coupling aperture, wherein the improvement comprises a heat transfer member provided in at least one of the pole pieces to extend from the drift tube to the outside of the pole piece, and embedded in the pole piece so that the heat transfer member does not expose to the space defined in the resonant cavity, the heat transfer member being made of copper which is having a heat conductivity higher than that of the pole piece. The heat transfer member is composed of a plate sandwiched by a pair of magnetic material plates each of which confines one resonant cavity, the heat transfer plate being brazed at its center portion to be drift tube and extending at least to the periphery of the magnetic material plates; and the heat transfer plate has a plurality of heat radiation fins integrally extending therefrom to project from the periphery of the magnetic material plates.

2. A delay line claimed in claim 1 wherein the heat transfer member includes a pair of heat transfer rods brazed at one end thereof to the drift tube and extending from the drift tube in diametrically opposite directions so that the other free end of each rod projects from the periphery of the pole piece.

3. A delay line claimed in claim 2 wherein the end of the heat transfer rod projecting from the periphery of the pole piece has a plurality of heat radiation fins.

4. A delay line claimed in claim 1 wherein the heat transfer member includes a pair of heat transfer rods extending in parallel to each other, these rods being brazed at their center portions to the drift tube in such a manner that the drift tube is interposed between the pair of rods in a diametrical direction, each end of the rods projecting from the periphery of the pole piece.

5. A delay line claimed in claim 4 wherein the end of the heat transfer rod projecting from the periphery of the pole piece has a plurality of heat radiation fins. center portion be drift tube and extending at least to the periphery of the magnetic material plates.

6. A delay line claimed in claim 4 wherein the heat transfer plate has a plurality of heat radiation fins provided at the periphery thereof.

7. A delay line claimed in claim 1 wherein each of the pole pieces has the heat transfer member extending from the drift tube to the outside of the pole piece.

8. A delay line claimed in claim 7 wherein each heat transfer member is composed of a plate sandwiched by a pair of magnetic material plates each of which confines one resonant cavity, the heat transfer plate being brazed at its center portion to be drift tube and extending at least to the periphery of the magnetic material plates.

9. A delay line claimed in claim 8 wherein each heat transfer plate has a plurality of heat radiation fins provided at the periphery thereof.

10. A delay line claimed in claim 8 wherein each heat transfer plate has a plurality of heat radiation fins integrally extending therefrom to project from the periphery of the magnetic material plates.

11. A delay line claimed in claim 1 wherein the heat transfer member includes a pair of heat transfer copper rods brazed at one end thereof to the drift tube and extending from the drift tube in diametrically opposite directions so that the other free end of each rod projects from the periphery of the pole piece.

12. A delay line claimed in claim 1 wherein the heat transfer member includes a pair of heat transfer copper rods extending in parallel to each other, these rods being brazed at their center portions to the drift tube in such a manner that the drift tube is interposed between the pair of rods in a diametrical direction, each end of the rods projecting from the periphery of the pole piece.

13. A delay line claimed in claim 1 wherein the heat transfer member is composed of a copper plate sandwiched by a pair of magnetic material plates each of which confines one resonant cavity, the heat transfer plate being brazed at its center portion to be drift tube and extending at least to the periphery of the magnetic material plates.

14. A coupled-cavity delay line for a traveling-wave tube which includes a device for focusing an electron beam along the axis of the delay line for interaction between the electron beam and an electromagnetic wave propagating along the delay line, the focusing device including an alternate series of permanent magnets and pole pieces which confine resonant cavities on each side, each of the pole pieces being made of a material having a heat conductivity which lower than the heat conductivity of copper and further being common to a pair of adjacent cavities and being provided with a drift tube which is positioned at a center thereof and which has a central aperture for passage of the electron beam, each of the pole pieces being also pierced by at least one intercavity coupling aperture, wherein the improvement comprises a pair of heat transfer copper rods brazed at one end thereof to the drift tube and provided in at least one of the pole pieces to extend from the drift tube in diametrically opposite direction and having their free ends projecting from the periphery of the pole piece the heat transfer member is embedded in the pole piece so that the heat transfer member does not expose to the space defined in the resonant cavity, the free ends of the respective heat transfer rods having a plurality of heat radiation fins.

15. A delay line claimed in claim 14 wherein each of the heat transfer rods extends in parallel to each other, these rods being brazed at their center portions to the drift tube in such a manner that the drift tube is interposed between the pair of rods in a diametrical direction, each end of the rods projecting from the periphery of the pole piece.

16. A coupled-cavity delay line for a traveling-wave tube which includes a device for focusing an electron beam along the axis of the delay line for interaction between the electron beam and an electromagnetic wave propagating along the delay line, the focusing device including an alternate series of permanent magnets and pole pieces which confine resonant cavities on each side, each of the pole pieces being made of a material having a heat conductivity which is lower than the heat conductivity of copper, and further being common to a pair of adjacent cavities and being provided with a drift tube which is positioned at a center thereof and which has a central aperture for passage of the electron beam, each of the pole pieces being also pierced by at least one intercavity coupling aperture, wherein the improvement is that at least one of the pole pieces is composed of a pair of magnetic material plates each of which confines one resonant cavity, and a heat transfer copper plate sandwiched by the pair of magnetic material plates, the heat transfer plate brazed at its center portion to be drift tube and extending at least to the periphery of the magnetic material plates, and the heat transfer plate having a plurality of heat radiation fins integrally extending therefrom to project from the periphery of the magnetic material plates.

* * * * *